US006640358B2

(12) United States Patent
Ball

(10) Patent No.: US 6,640,358 B2
(45) Date of Patent: Nov. 4, 2003

(54) STRAINER ASSEMBLY FOR BATHTUB DRAINS AND THE LIKE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 09/777,647

(22) Filed: Feb. 6, 2001

(65) Prior Publication Data

US 2001/0007159 A1 Jul. 12, 2001

Related U.S. Application Data

(63) Continuation of application No. 09/451,434, filed on Nov. 30, 1999, now abandoned, which is a continuation of application No. 09/037,485, filed on Mar. 10, 1998, now Pat. No. 6,317,906.

(51) Int. Cl.[7] ..... E03C 1/23
(52) U.S. Cl. ..... 4/679; 4/288
(58) Field of Search ..... 4/287, 288, 289, 4/291, 295, 684, 685, 689, 690, 691, 692

(56) References Cited

U.S. PATENT DOCUMENTS 1,661,983 A 3/1928 Wentzel et al.
2,697,840 A 12/1954 Steele
3,169,254 A 2/1965 Lantz et al.
3,800,339 A 4/1974 Bergin
4,006,498 A 2/1977 Cuschera
4,146,939 A 4/1979 Izzi
4,720,877 A 1/1988 Watts
5,363,518 A 11/1994 Mowery

*Primary Examiner*—Robert M. Fetsuga

(57) ABSTRACT

A strainer assembly for bathtub drains has a strainer body with a circular horizontal flange having a center opening and which is adapted to fit over and around a vertically disposed drain port in the bottom of a tub or the like. A hollow bushing extension extends downwardly from the center opening and terminates in an open lower portion with external threads. A hollow attachment bushing having a center opening is threadably secured around the lower portion of the bushing extension and extends downwardly therefrom. The attachment bushing has a lower open end with at least one crossbar extending thereacross. A bearing hub is formed in the center of the crossbar on the center axis of the aforesaid center openings. A vertically disposed threaded aperture is located in the hub and is adapted to threadably receive a connecting stud from a drain strainer or closure valve.

1 Claim, 2 Drawing Sheets

STRAINER ASSEMBLY FOR BATHTUB DRAINS AND THE LIKE

This application is a continuation of application Ser. No. 09/451,434 filed Nov. 30, 1999, abandoned, which is a continuation of Ser. No. 09/037,485 filed Mar. 10, 1998 U.S. Pat No. 6,317,906.

BACKGROUND OF THE INVENTION

Bathtub drains conventionally have a strainer assembly associated therewith which includes a horizontal flange that extends around the drain opening in engagement with the bottom of the tub. A threaded portion extends downwardly from the center opening of the flange and terminates in an open bottom with crossbars extending thereacross. A hub exists at the intersection of the crossbars and has a threaded aperture therein to receive the threaded stud of a strainer or a closure valve. A threaded bushing conventionally extends around the lower portion of the foregoing component and serves to connect the flange and related structure to the tub structure.

It is often necessary to replace the conventional strainer assembly because the flange extending around the conventional drain becomes damaged, discolored, or the like. Thus, the entire assembly described above must be replaced. Such conventional strainer assemblies are relatively expensive and this expense is significantly attributed to the crossbars at the bottom of the device wherein the threaded aperture receives the threaded stub from a strainer or valve.

It is therefore a principal object of this invention to provide a strainer assembly wherein the part of the assembly involving the horizontal flange can be easily, quickly and economically replaced.

A further object of this invention is to provide a strainer assembly for bathtub drains and the like which includes the mounting structure for a strainer or the like in the conventional bushing of a strainer assembly and not in the portion of the device attached to the flange itself.

These and other objects will be apparent to those skilled in the art.

SUMMARY OF THE INVENTION

The strainer assembly of this invention has a strainer body with a circular horizontal flange having a center opening and which is adapted to fit over and around a vertically disposed drain port in the bottom of a tub or the like. A hollow bushing extension extends downwardly from the center opening and terminates in an open lower portion with external threads. A hollow attachment bushing having a center opening is threadably secured around the lower portion of the bushing extension and extends downwardly therefrom.

The attachment bushing has a lower open end with at least one crossbar extending thereacross. A bearing hub is formed in the center of the crossbar on the center axis of the aforesaid center openings. A vertically disposed threaded aperture is located in the hub and is adapted to threadably receive a connecting stud from a drain strainer or closure valve.

DESCRIPTION OF THE PREFERRED EMBODIMENTS

Figure 1:
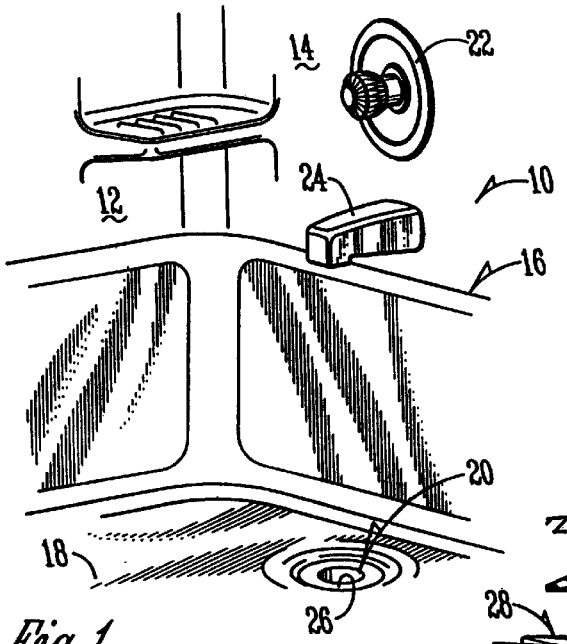
FIG. 1 is a partial perspective view of a conventional bathtub structure.

As shown in FIG. 1, a bath compartment 10 has conventional walls 12 and 14 and a conventional bathtub 16. The tub 16 has a bottom 18 and a conventional vertical drain 20. A conventional water control valve 22 is located on wall 14 as is a conventional water outlet 24. A conventional drain flange 26 surrounds the drain 20.

Figure 3:
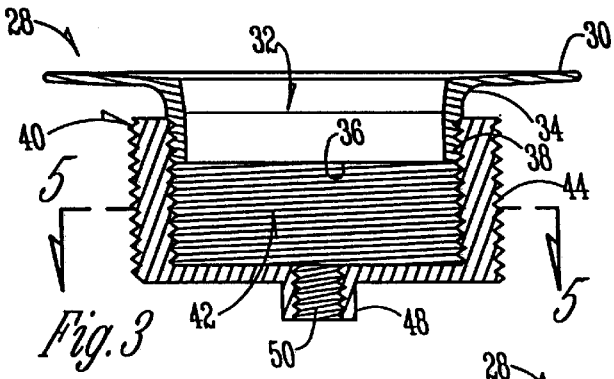
FIG. 3 is a cross sectional view of the strainer assembly of this invention.
Figure 4:
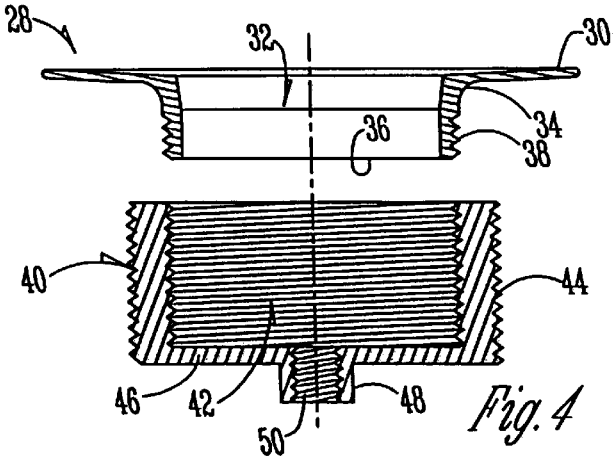
FIG. 4 is an exploded disassembled view of the device of FIG. 3.
Figure 5:
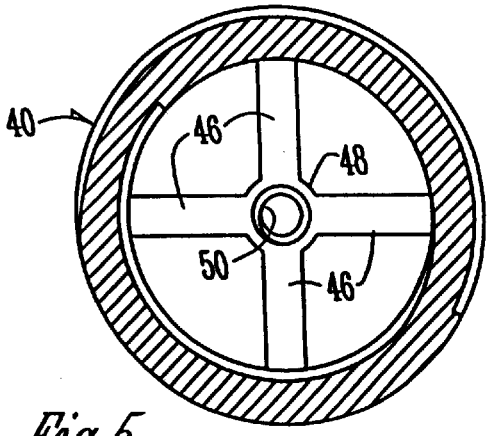
FIG. 5 is a sectional view taken on line 5—5 of FIG. 3.
Figure 6:
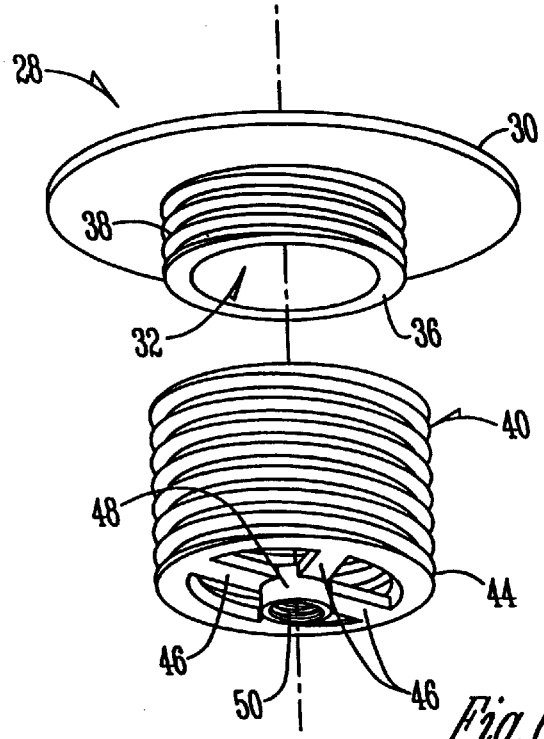
FIG. 6 is an exploded lower perspective view of the assembly of FIG. 4.

With reference to FIGS. 3, 4 and 6, the strainer assembly 28 of this invention has a horizontal flange 30 which is similar to the conventional horizontal flange 26. The flange 30 has a center opening 32. A bushing extension 34 extends downwardly from the center opening 32 and terminates in an open lower end 36. The bushing extension 34 is integral with the horizontal flange 30 and has external threads 38 (FIG. 4).

An attachment bushing 40 (FIGS. 3, 4 and 6) having internal and external threads has a center opening 42 and an open lower end 44. A pair of crossbars 46 extend across the lower open end 44 and hub 48 is located at the intersection of the crossbars 46. A vertically disposed threaded aperture 50 is located in the center of hub 48. Bushing 40 is threadably mounted on the threads 38 of bushing extension 34.

Figure 2:
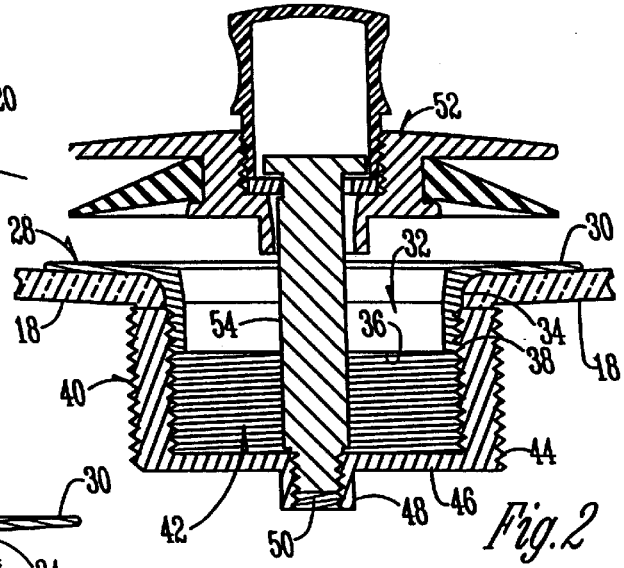
FIG. 2 is an enlarged sectional view of the strainer assembly of this invention with a conventional closure valve mounted thereon.

A conventional closure valve 52 is shown in FIG. 2 and has a conventional downwardly extending threaded stud 54. As discussed hereafter, the threaded stub 54 can be threadably received for attachment purposes in the threaded aperture 50 on hub 48 which is a part of the attachment bushing 40.

The essence of this invention is that the crossbars 46 are mounted at the bottom of the attachment bushing 40 rather than at the bottom of the bushing extension 34 which is the conventional practice. As a result of changing the location of the crossbars 46 as described above, the horizontal flange 30 can be easily unscrewed from the interior of bushing 40 and can be easily replaced. The flange 30 and its bushing extension 34 are relatively inexpensive because they do not involve the expense of the conventional crossbars that are located in conventional devices. Thus, the replacement of a horizontal flange 30 does not require that the replacement horizontal flange have constructed therein a set of crossbars for purposes of mounting a closure valve 52 or the like.

As a result, this invention provides a substitute horizontal flange 30 which eliminates the expense of using a substitute horizontal flange with the expensive crossbars therein. Thus, the crossbars 46 in the attachment bushing 40 are permanently installed in the bushing 40 and never need to be replaced even though the flange 30 is replaced.

Thus, it is seen that this invention achieves at least all of its stated objectives.

What is claimed is:

1. The combination of a fluid compartment having a bottom with a waste water strainer assembly mounted in a circular drain opening in the bottom and wherein a horizontal flange on the bottom extends around the circular drain opening, comprising, a two piece strainer assembly having a circular horizontal flange with a center opening extending over the drain opening with the circular horizontal flange extending over the horizontal flange on the bottom which extends around the drain opening, the strainer assembly including a hollow bushing extension extending downwardly from the horizontal flange of the strainer assembly through the circular drain opening on the bottom, a hollow attachment bushing having a center opening threadably secured around a lower portion of the bushing extension and extending downwardly therefrom, and at least one crossbar extending thereacross, a bearing hub formed in the center of said crossbar on the center axis of said center openings, and a vertically disposed threaded aperture in said hub to threadably receive a threaded connecting stud of a closure valve, threads on the interior upper end of the attachment bushing threadably engaging threads on the lower portion of the hollow bushing to permit the upper end of the attachment bushing to engage directly a lower portion of the circular horizontal flange on the bottom to be tightly bound between the upper end of the attached bushing and a lower surface of the circular horizontal flange of the strainer assembly.

* * * * *